US005647540A

United States Patent [19]

Buckley

[11] Patent Number: 5,647,540

[45] Date of Patent: Jul. 15, 1997

[54] FUEL INJECTION NOZZLE

[75] Inventor: Paul Buckley, Rainham, Great Britain

[73] Assignee: Lucas Industries Public Limited Company, Solihull, England

[21] Appl. No.: 515,223

[22] Filed: Aug. 15, 1995

[30] Foreign Application Priority Data

Aug. 19, 1994 [GB] United Kingdom ..... 94 16785

[51] Int. Cl.[6] ..... F02M 45/08

[52] U.S. Cl. ..... 239/533.2; 239/533.9

[58] Field of Search ..... 239/533.1, 533.2, 239/533.3, 533.4, 533.5, 533.7, 533.9, 583; 137/625.37, 509, 529

[56] References Cited

U.S. PATENT DOCUMENTS

| | | | |
|---|---|---|---|
| 3,718,283 | 2/1973 | Fenne | 239/533 |
| 4,768,719 | 9/1988 | Straubel et al. | 239/533.4 |
| 5,165,607 | 11/1992 | Stevens | 239/533.9 |
| 5,282,577 | 2/1994 | Neitz | 239/533.4 |

FOREIGN PATENT DOCUMENTS

| | | |
|---|---|---|
| 785411 | 10/1957 | United Kingdom . |
| 2 093 118 | 8/1982 | United Kingdom . |

*Primary Examiner*—Andres Kashnikow
*Assistant Examiner*—Lisa Ann Douglas
*Attorney, Agent, or Firm*—Jacobson, Price, Holman & Stern, PLLC

[57] ABSTRACT

A fuel injection nozzle includes a fuel pressure actuated valve member which is biased by a first spring into engagement with a seating. A pre lift stop is engaged by a surface which moves with the valve member after a predetermined movement of the valve member away from the seating. The lift stop is movable against the action of a second spring to allow continued movement of the valve member. The lift stop position is determined by a yieldable abutment which during the closing movement of the valve member towards the seating, yields under the action of the inertia of the pre lift stop to assist the closing movement of the valve member.

7 Claims, 3 Drawing Sheets

FUEL INJECTION NOZZLE

BACKGROUND OF THE INVENTION

This invention relates to fuel injection nozzles for supplying fuel to compression ignition engines and of the kind comprising a fuel pressure actuated valve member which is engageable with a seating to prevent flow of fuel through an outlet orifice located downstream of the seating from a fuel inlet, a first coiled compression spring acting on the valve member to bias the valve member into engagement with the seating, a pre lift stop engageable by a surface moveable with the valve member after the valve member has moved to a predetermined position away from the seating, and a second coiled compression spring acting on the pre lift stop whereby continued movement of the valve member away from the seating beyond said predetermined position takes place against the action of both springs.

Such nozzles are well known in the art and may be of the sac type or pintle type. The initial movement of the valve member to the predetermined position allows for a restricted flow of fuel through the outlet to the associated engine, the rate of flow increasing as the valve member is moved beyond the predetermined position by an increase in the pressure of fuel at the inlet.

When the fuel pressure at the inlet falls the valve member moves to the closed position initially under the action of both springs but finally under the action of the first spring only and it is found that the valve member can "hang" at the position where the second spring becomes ineffective. This is undesirable because rapid closure of the valve member is required to prevent fuel dribble which might result in increased exhaust emissions.

SUMMARY OF THE INVENTION

The object of the present invention is to provide a fuel injection nozzle of the kind specified in an improved form.

According to the invention in a fuel injection nozzle of the kind specified the inertia of the pre lift stop is utilised to assist the closing movement of the valve member at least in the initial portion of its movement from said predetermined position towards the seating.

DESCRIPTION OF THE DRAWINGS

Referring to FIG. 1 of the drawings, the fuel injection nozzle includes a nozzle body 10 of stepped form extending into which from one and wider end thereof is a blind bore 11. At the blind end of the bore there is defined a frusto conical seating 12 which leads into a sac volume from which extends in the example, a single outlet orifice 13. Intermediate the ends of the bore there is formed an enlargement 14 and this communicates with a fuel inlet 15 defined in a cylindrical nozzle holder 16 to which the nozzle body is secured by means of a screw threaded cap nut 17. Interposed between the nozzle body 10 and the holder 16 is a distance piece 18.

Figure 1:
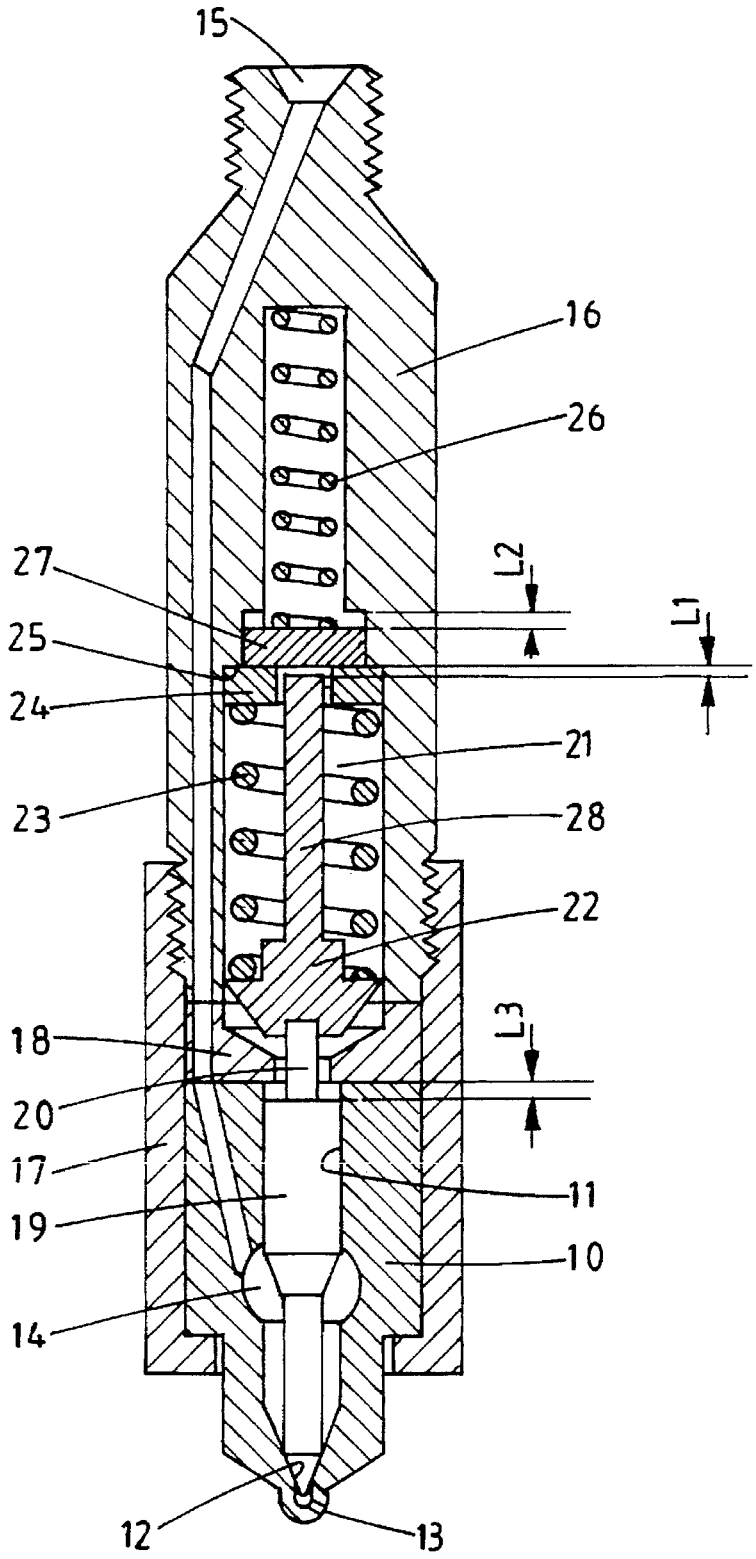
FIG. 1 is a sectional elevational view of a first fuel injection nozzle according to the invention.

Slidably mounted in the bore 11 is a valve member 19 having an integral extension 20 of reduced diameter which extends from the bore. The opposite end of the valve member is shaped for cooperation with the seating 12 and the valve member intermediate the shaped end thereof and the enlargement 14 is of reduced diameter so as to allow fuel flow when the valve member is lifted from its seating, from the inlet 15 through the orifice 13.

Formed in the holder 16 is a stepped chamber 21 and located in the wider portion of the chamber which is that portion adjacent the distance piece, is a spring abutment 22 which is mounted on the extension 20 of the valve member. The abutment is contacted by one end of a first coiled compression spring 23 and the opposite end of this spring engages an abutment 24 which is slidable within the wider portion of the chamber but which is urged by the action of the spring, into engagement with a step 25 defined in the chamber. In the narrower portion of the chamber there is located a second coiled compression spring 26 one end of which is in engagement with the end wall of the chamber and the other end of which is in engagement with a pre lift stop 27 which has a diameter intermediate that of the wider and narrower portions of the chamber, the latter defining an intermediate portion which guides the movement of the pre lift stop. In addition, the spring abutment 22 carries a peg 28 which in the closed position of the valve member as shown in the drawing, is spaced by a distance L1 from the pre lift stop 27. The two portions of the chamber are vented to a drain by passages not shown. Moreover, in the example the spring 23 is stronger than the spring 26 so that the spring abutment 24 is maintained in contact with the step 25.

In operation, when fuel under pressure is supplied to the inlet 15 the pressure acts on the valve member to generate a force acting on the valve member in opposition to the force exerted by the first spring 23. When the pressure increases to a sufficiently high value the force generated by the fuel pressure moves the valve member against the action of the spring 23 to lift the valve member from the seating. In the initial phase the maximum movement is limited by the engagement of the peg 28 with the pre lift stop 27 and in this setting the rate of flow of fuel through the orifice 13 is limited by the throttling action of the small clearance between the shaped end of the valve member and the seating 12. As the pressure continues to increase the force acting on the valve member will increase and further movement of the valve member will take place against the action of both springs and the clearance between the valve member and the seating will increase to the extent that there is substantially no restriction to the flow of fuel through the orifice 13. The maximum movement of the valve member away from the seating can be determined by the engagement of the main body of the valve member with a projecting portion of the distance piece 18 or by limiting the movement of the pre lift stop 27 by allowing it to engage with a step defined at the end of the intermediate chamber in which it is located. In either event the maximum lift of the valve member is indicated by the distance L3 between the distance piece and the valve member or by the sum of the distances L1 and L2 in the case where the pre lift stop 27 engages the aforesaid step.

When the pressure at the inlet falls the valve member is moved towards the closed position initially by the action of both springs and assuming that the spring abutment 24 is fixed, as in the prior art, finally by the action of the spring 23. When the pre lift stop 27 engages the fixed spring abutment 24 the spring force acting to return the valve member is suddenly reduced and it is found that the rate of movement of the valve member towards the closed position falls and in some cases there is a temporary halt in its movement. This is due simply to the fact that during the initial movement both springs were acting on the valve member but during the final movement spring 23 alone acts on the valve member. In accordance with the invention, the spring abutment 24 is slidable in the chamber and this has the effect that the inertia gained by the pre lift stop 27 and a portion of the spring 26, displaces the spring abutment 24 away from the step 25 thereby effecting an increase in the force exerted by the spring 23. Furthermore, the pre lift stop will engage the peg 28 for a portion of the closure stroke of the valve member. Utilisation of the inertia of the pre lift stop and the spring results in a more rapid movement of the valve member towards the closed position.

Figure 2:
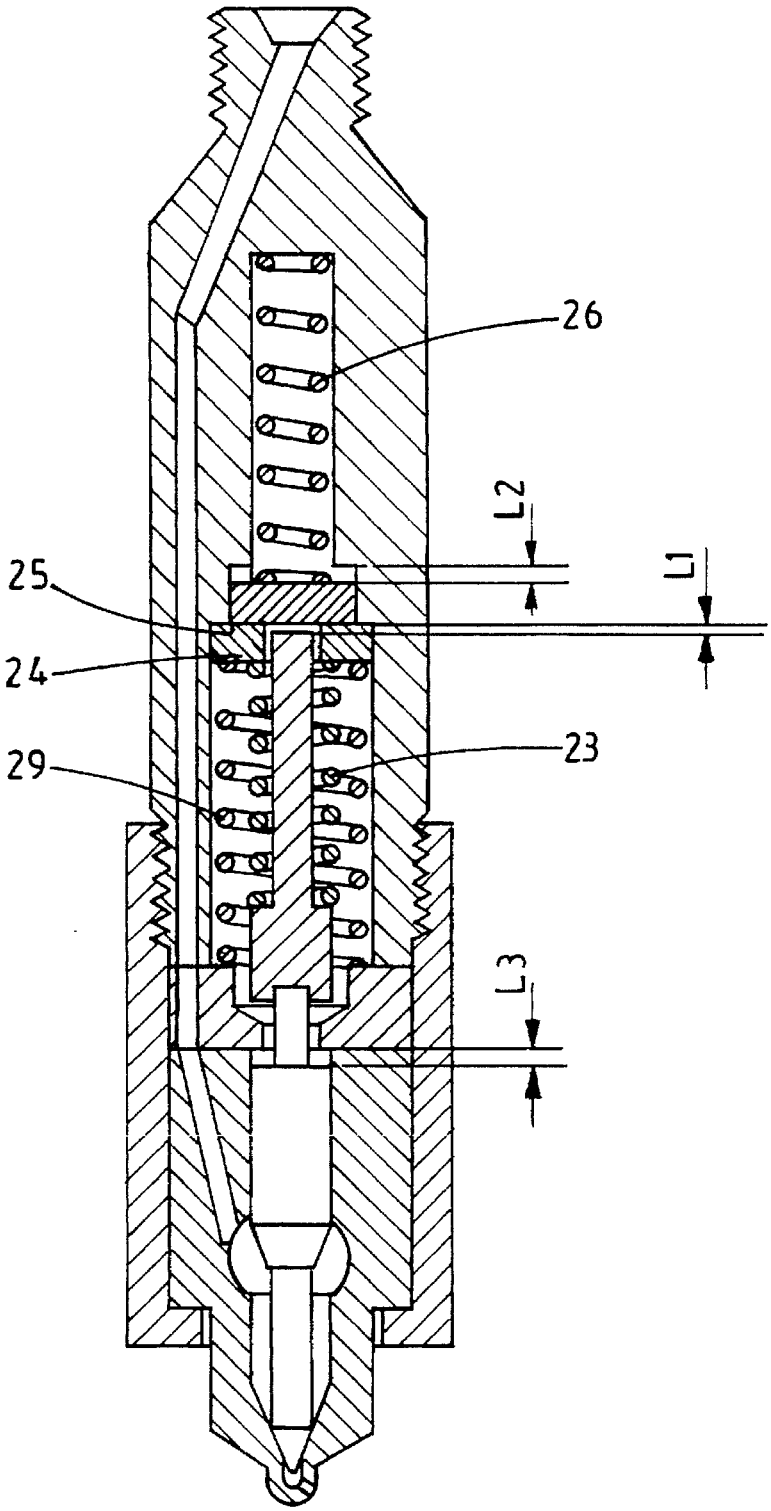
FIG. 2 is a sectional elevational view of a second fuel injection nozzle according to the invention.

In the arrangement shown in FIG. 2, the spring 23 is weaker than the spring 26. This would have the effect that the abutment 24 would not be maintained in contact with the step 25 in the closed position of the valve member. The force exerted by the spring 23 determines the pressure at which the valve member is lifted from the seating and depending on the application, it is quite possible for the spring 23 to be weaker than the spring 26. In order to maintain the spring abutment 24 in engagement with the step 25 a further spring 29 is provided which acts intermediate the spring abutment 24 and the distance piece and which acts to supplement the force exerted by the spring 23 on the spring abutment. During the return motion of the valve member, the inertia of the pre lift stop is utilized as described with reference to FIG. 1 but some of the inertia will be used to compress the spring 29 which should therefore only be sufficiently strong so that in conjunction with the spring 23 the abutment is maintained in contact with the step 25 in the closed position of the valve member.

Figure 3:
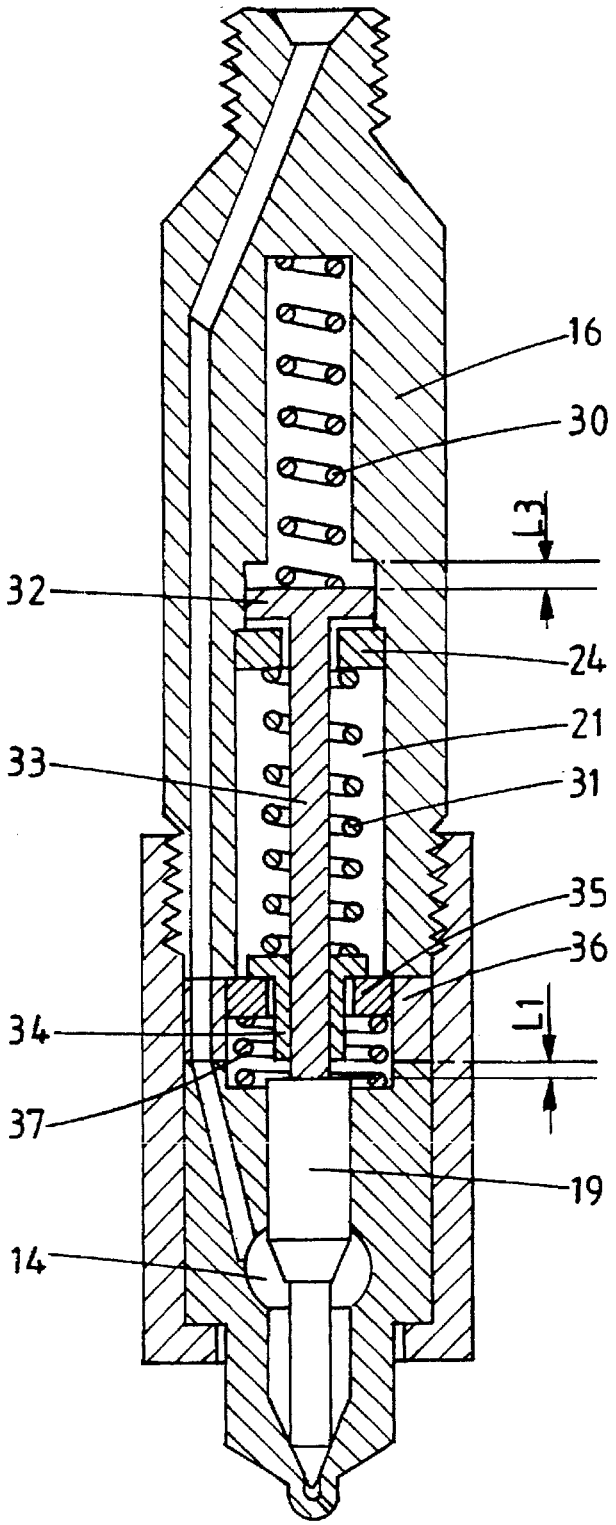
FIG. 3 is a sectional elevational view of a third fuel injection nozzle according to the invention.

In the arrangement shown in FIG. 3 the positions of the two springs are reversed so that the spring 30 which corresponds to the spring 23 is located in the narrower portion of the chamber 21 and the spring 31 which corresponds to the spring 26 is located in the wider portion of the chamber. The spring 30 engages a spring abutment 32 which is slidable in the intermediate portion of the chamber, and has an integral rod 33 the remote end of which engages with the valve member 19. The spring 31 engages at one end a spring abutment 24 and at its other end with a flanged collar 34 slidable about the rod 33, the collar forming the pre lift stop. The position of the pre lift stop 34 in the closed position of the valve member as shown in FIG. 3, is determined by an annular stop member 35 which is slidably located within a suitable bore formed in a distance piece 36. The stop member 35 is biassed into engagement with the end wall of the supporting body 16 by means of a further coiled compression spring 37.

In operation, the force exerted by the spring 30 is transmitted through the rod 33 to hold the valve member 19 in engagement with the seating and as in the previous examples, when the fuel pressure in the enlargement 14 rises to a sufficiently high value the force generated on the valve member by the pressure will overcome the force exerted by the spring 30 and the valve member will lift away from the seating and will move into engagement with the end of the pre lift stop 34. This initial movement of the valve member allows a restricted flow of fuel to the associated engine. As the fuel pressure which is supplied to the enlargement 14 increases, the valve member will eventually move against the action of both springs 30 and 31 and the limit of movement is determined by the engagement of the abutment 32 with the end wall of the intermediate portion of the chamber.

When the pressure of fuel supplied to the enlargement 14 falls the valve member 19 moves to the closed position and whereas if the stop member 35 were fixed, the final movement of the valve member to the closed position would be under the action of the spring 30 only, the fact that the stop member 35 is moveable allows the inertia gained by the pre lift stop 34 and the spring 31 to displace the stop member against the action of the spring 37 and during such displacement the pre lift stop is maintained in engagement with the valve member to assist its movement to the closed position for at least part of the closing stroke of the valve member.

I claim:

1. A fuel injection nozzle for supplying fuel to a compression ignition engine and comprising a fuel pressure actuated valve member engageable with a seating to prevent flow of fuel through an outlet orifice located downstream of the seating from a fuel inlet, a first coiled compression spring acting on the valve member to bias the valve member into engagement with the seating, a pre lift stop engageable by a surface movable with the valve member after the valve member has moved to a predetermined position away from the seating, a second coiled compression spring acting on the pre lift stop whereby continual movement of the valve member away from the seating takes place against the action of both springs, and supporting means for the pre lift stop movable towards the seating under pressure exerted thereon by the pre lift stop during closing movement of the valve member for enabling inertia of the pre lift stop to assist the closing movement of the valve member at least in an initial portion of its movement towards the seating from said predetermined position.

2. A nozzle according to claim 1, characterized in that said pre lift stop forms an abutment for said second coiled compression spring, and wherein the supporting means comprises a spring abutment engaged by the first coiled compression spring to locate the pre lift stop at a position to determine said predetermined position of the valve member.

3. A nozzle according to claim 2, characterised in that said spring abutment is urged into engagement with a step defined in a holder forming part of the nozzle.

4. A nozzle according to claim 3, characterised in that said spring abutment is acted upon by a further coiled compression spring to urge it into engagement with said step.

5. A nozzle according to claim 2, characterised by a peg movable with the valve member and engageable with said pre lift stop to determine said predetermined position of the valve member.

6. A nozzle according to claim 1, characterized by a rod which transmits the force exerted by the first coiled compression spring to the valve member, said pre lift stop being in the form of a collar slidable about said rod and wherein the supporting means is engageable with said collar to locate the collar at a position so as to determined said predetermined position of the valve member.

7. A nozzle according to claim 6, characterised in that said supporting means comprises a movable stop member which is biased into engagement with a shoulder defined by a part of the nozzle by a further spring and which is displaceable away from said shoulder by the inertia of pre lift stop.

* * * * *